US008100103B2

(12) United States Patent
Ribeiro

(10) Patent No.: US 8,100,103 B2
(45) Date of Patent: Jan. 24, 2012

(54) RECIPROCATING PISTON CYLINDER HEAD COVER HAVING AN INTEGRATED FLUID EXCHANGE ROTARY DISC VALVE

(76) Inventor: Renato Bastos Ribeiro, Porto Alegre (BR)

( * ) Notice: Subject to any disclaimer, the term of this patent is extended or adjusted under 35 U.S.C. 154(b) by 700 days.

(21) Appl. No.: 12/204,399

(22) Filed: Sep. 4, 2008

(65) Prior Publication Data

US 2009/0064961 A1 Mar. 12, 2009

Related U.S. Application Data

(60) Provisional application No. 60/970,830, filed on Sep. 7, 2007.

(51) Int. Cl.
*F01L 7/00* (2006.01)

(52) U.S. Cl. ..... 123/190.14; 123/193.1; 123/193.2; 123/193.3; 123/193.5; 123/80 R; 123/80 BA; 417/571; 417/243; 251/129.11

(58) Field of Classification Search ..... 123/190.14, 123/193.1, 193.5, 190.1, 190.4, 190.8, 80 R, 123/80 BA, 80 BB; 137/899.4, 317.18; 251/304
See application file for complete search history.

(56) References Cited

U.S. PATENT DOCUMENTS

| | | | | |
|---|---|---|---|---|
| 3,308,796 | A * | 3/1967 | Guy et al. | 123/46 B |
| 3,369,531 | A * | 2/1968 | Johnson | 123/65 V |
| 4,313,401 | A * | 2/1982 | Monn | 123/41.4 |
| 4,321,904 | A | 3/1982 | Bristol | |
| 4,782,801 | A * | 11/1988 | Ficht et al. | 123/190.8 |
| 5,020,973 | A * | 6/1991 | Lammers | 417/243 |
| 5,173,040 | A * | 12/1992 | Yamazawa et al. | 417/571 |
| 5,570,665 | A * | 11/1996 | Regueiro | 123/90.27 |
| 5,911,203 | A | 6/1999 | Lambert et al. | |
| 5,941,206 | A * | 8/1999 | Smith et al. | 123/190.4 |
| 5,988,133 | A * | 11/1999 | Agapiades et al. | 123/190.14 |
| 6,199,531 | B1 | 3/2001 | Daniels | |
| 6,443,717 | B1 * | 9/2002 | Barber | 417/510 |
| 6,598,851 | B2 * | 7/2003 | Schiavone et al. | 251/129.11 |
| 6,694,942 | B1 | 2/2004 | Massmann et al. | |
| 6,976,465 | B2 * | 12/2005 | Agapiades | 123/190.14 |
| 7,213,547 | B2 * | 5/2007 | Peliks et al. | 123/80 R |
| 2004/0107937 | A1 * | 6/2004 | Coates | 123/190.1 |
| 2006/0185640 | A1 | 8/2006 | Barnes | |
| 2007/0119189 | A1 | 5/2007 | Gao | |

FOREIGN PATENT DOCUMENTS

| | | |
|---|---|---|
| WO | WO 01/11204 | 2/2001 |

* cited by examiner

*Primary Examiner* — Michael Cuff
*Assistant Examiner* — Long T Tran
(74) *Attorney, Agent, or Firm* — Greenberg Traurig LLP

(57) ABSTRACT

A cylinder head cover for a reciprocating compressor cylinder. The cover includes a first plate having a first and second channel in a surface of the first plate. The first and second channels merge within the plate at a first opening through the bottom surface of the first plate. A second plate has a pair of bores each aligned with one of the first and second channels in the first plate. A fourth plate is fastened over the second plate forming a cavity between the second and fourth plates. The fourth plate has a pair of spaced bores aligned with the bores through the second plate. A rotating third plate is disposed between the second and fourth plates. This third plate has a pair of spaced bores for sequentially aligning with one of the pair of bores through the second plate.

31 Claims, 13 Drawing Sheets

RECIPROCATING PISTON CYLINDER HEAD COVER HAVING AN INTEGRATED FLUID EXCHANGE ROTARY DISC VALVE

RELATED APPLICATION

This application claims the benefit of and priority to U.S. Provisional Application Ser. No. 60/970,830, filed Sep. 7, 2007, the content of which is incorporated by reference herein in its entirety.

BACKGROUND

The present disclosure is generally related to fluid compression machines, and more particularly to control of fluid entry and exit from cylindrical compression chambers in machines such as internal combustion engines and gas compressors.

Fluid compression machines generally include a piston reciprocating within a cylinder and a cylinder head or cylinder head cover (both will herein be referred to as a cylinder head cover). Cylinder head covers are well known for use in air compressors, gas compressors, and internal combustion engines. The cylinder head cover is generally capable of allowing fluids (gases, liquids, or a combination of the two) to enter and exit the cylinder, sometimes via a valve. Valves can allow fluids to flow in multiple directions, or they can be unidirectional (e.g., check valves).

SUMMARY

This disclosure describes a reciprocating piston cylinder head cover having a fluid exchange rotary disc valve. The cylinder head cover incorporates a rotating disc valve to control fluid entry and exit from the cylinder in a manner which is quieter and more efficient than current cylinder head designs. The cover preferably includes a first plate having a first and second channel in a surface of the first plate, wherein the first and second channels merge together within the plate at a first opening through the bottom surface of the first plate. A second plate is fastened over the first plate. The second plate has a pair of bores therethrough each aligned with one of the first and second channels in the first plate. A fourth plate is fastened over the second plate forming a cavity between the second and fourth plates. The fourth plate has a pair of spaced bores therethrough aligned with the bores through the second plate A rotating third plate is rotatably disposed between the second and fourth plates. This third plate has a pair of spaced bores therethrough for sequentially aligning with one of the pair of bores through the second plate. During a full rotation of the third plate each bore through the third plate aligns with each bore through the second and fourth plates.

One exemplary example is a cylinder head cover that is disclosed for use on a cylinder containing a piston reciprocating along an axis through the cylinder. This exemplary cover has stationary first, second and fourth axially aligned disc shaped plates stacked together and a rotary third plate enclosed between the second and fourth plates. The first plate has a single bore therethrough that is preferably positioned to be axially aligned with the piston axis when the plate is installed on the cylinder. This bore leads through the plate from a bottom surface of the first plate and diverges into a V-shaped channel through the top surface of the first plate. The second stationary plate is positioned axially on the first plate. The second plate has a flat bottom surface, a peripheral rim portion fastened to the first plate, and a central axially recessed portion. The central axially recessed portion has a pair of spaced holes therethrough, each aligned with and communicating with a different end of the V-shaped channel in the top surface of the first plate. The central recessed portion of the second plate has a central axial blind bore in the upper surface thereof housing an annular lower radial, bearing therein.

The stationary fourth plate is fastened to the rim portion of the second plate, and thence to the cylinder, forming a cavity between the fourth plate and the central portion of the second plate, that receives the third, or rotary valve plate therein. The fourth plate has a central axial bore therethrough and two spaced bores therethrough each parallel to and spaced from the central bore and arcuately spaced from each other. The central bore includes a bearing recess for receiving and supporting an upper radial bearing therein.

The third plate has a central axle shaft with the upper and lower bearings thereon sandwiching the rotary third plate therebetween. The rotary third plate is positioned in the cavity formed between the second and fourth plates. The rotary third plate has a pair of ports therethrough such that as the shaft rotates the third plate, the ports sequentially align with the bores through the second and fourth stationary plates. These ports may be circular, oblong, or elongated, and may be diametrically spaced on opposite sides of the axle or arcuately spaced, depending on the timing required for operation of the particular compressor system to which the cylinder head cover is applied.

These and various other features as well as advantages will be apparent from a reading of the following detailed description and a review of the associated drawings. Additional features are set forth in the description which follows, and in part will be apparent from the description, or can be learned by practice of the described embodiments. The benefits and features will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The following drawing figures, which form a part of this application, are illustrative of embodiments of the cylinder head cover described below and are not meant to limit the scope of the disclosure in any manner. The scope of the disclosure shall be based on the claims appended hereto.

DETAILED DESCRIPTION

Reference will now be made in detail to the accompanying drawings, which at least assist in illustrating various pertinent embodiments of the present disclosure.

Figure 1:
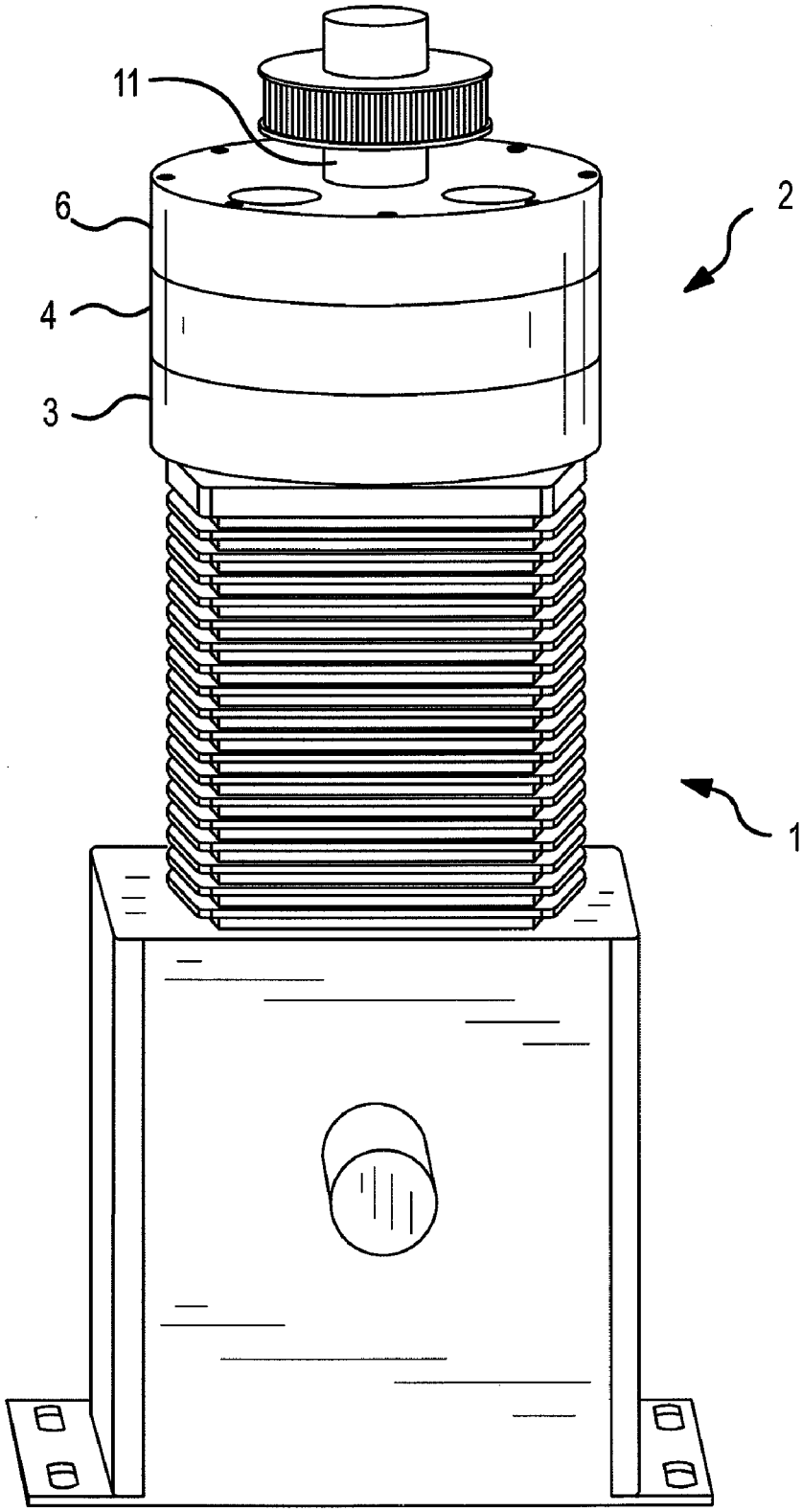
FIG. 1 is a perspective side view of a compressor having a cylinder head cover connected to the top of a compressor cylinder in accordance with one embodiment of the present disclosure.

FIG. 1 illustrates one embodiment of a cylinder head cover connected to the top of a compressor. In the illustrated embodiment, the cylinder head cover (2) is disposed atop the compressor cylinder (1). The cylinder head cover (2) comprises a first plate (3), a second plate (4), a third plate (5) (not visible), and a fourth plate (6). There is also an axle (11) connected to the third plate (5). Subsequent figures and the description will describe these components in further detail. As used herein, the term plates is synonymous with the term discs.

Figure 2:
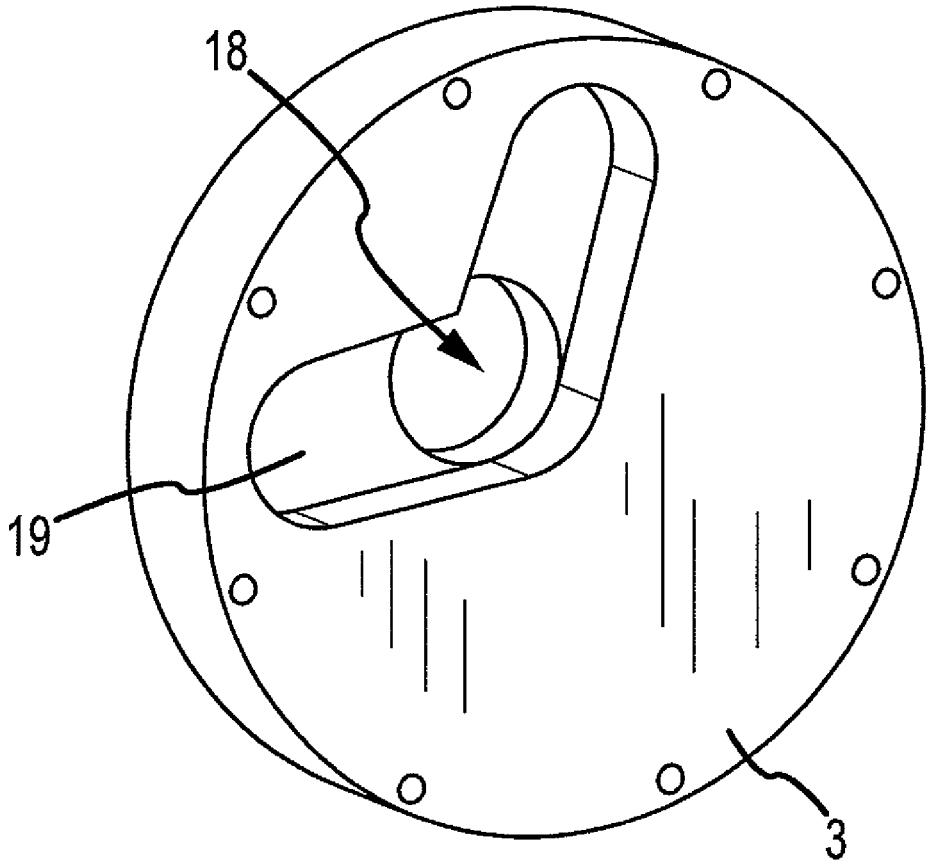
FIG. 2 is a perspective view of the top side of the first plate separated from the compressor shown in FIG. 1.
Figure 3:
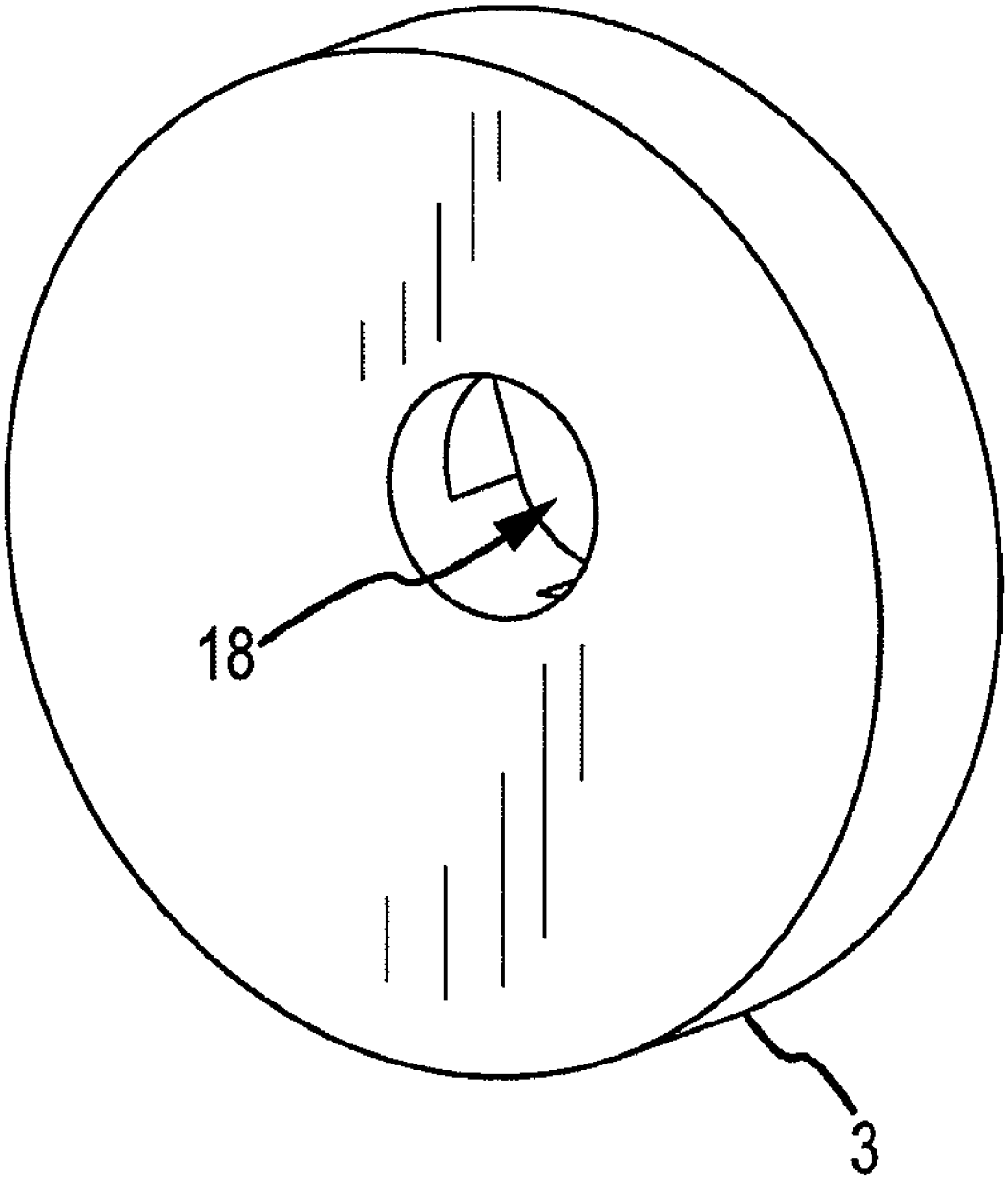
FIG. 3 is a bottom perspective view of the first plate shown in FIG. 2.

FIG. 2 is a separate perspective upper view of one embodiment of a first plate (3) of the cylinder head cover (2) of FIG. 1. The first plate (3) of the cylinder head cover (2) has a single axial bore, or opening (18) therethrough that merges with the apex of a V-shaped channel (19) in the upper surface of the first plate. Fluids enter and exit the compressor cylinder (1) via the single opening (18). In the illustrated embodiment, the angle of the V-shaped channel (19) is greater than 90°. FIG. 3 is a lower perspective view of this first plate (3). In an embodiment, the opening (18) is axially aligned with the center of the first plate (3). In another embodiment, the opening (18) is not axially aligned with the center of the first plate (3). In another embodiment, there are two channels (19) that merge with a single opening (18) in the bottom surface of the first plate (3).

Figure 4:
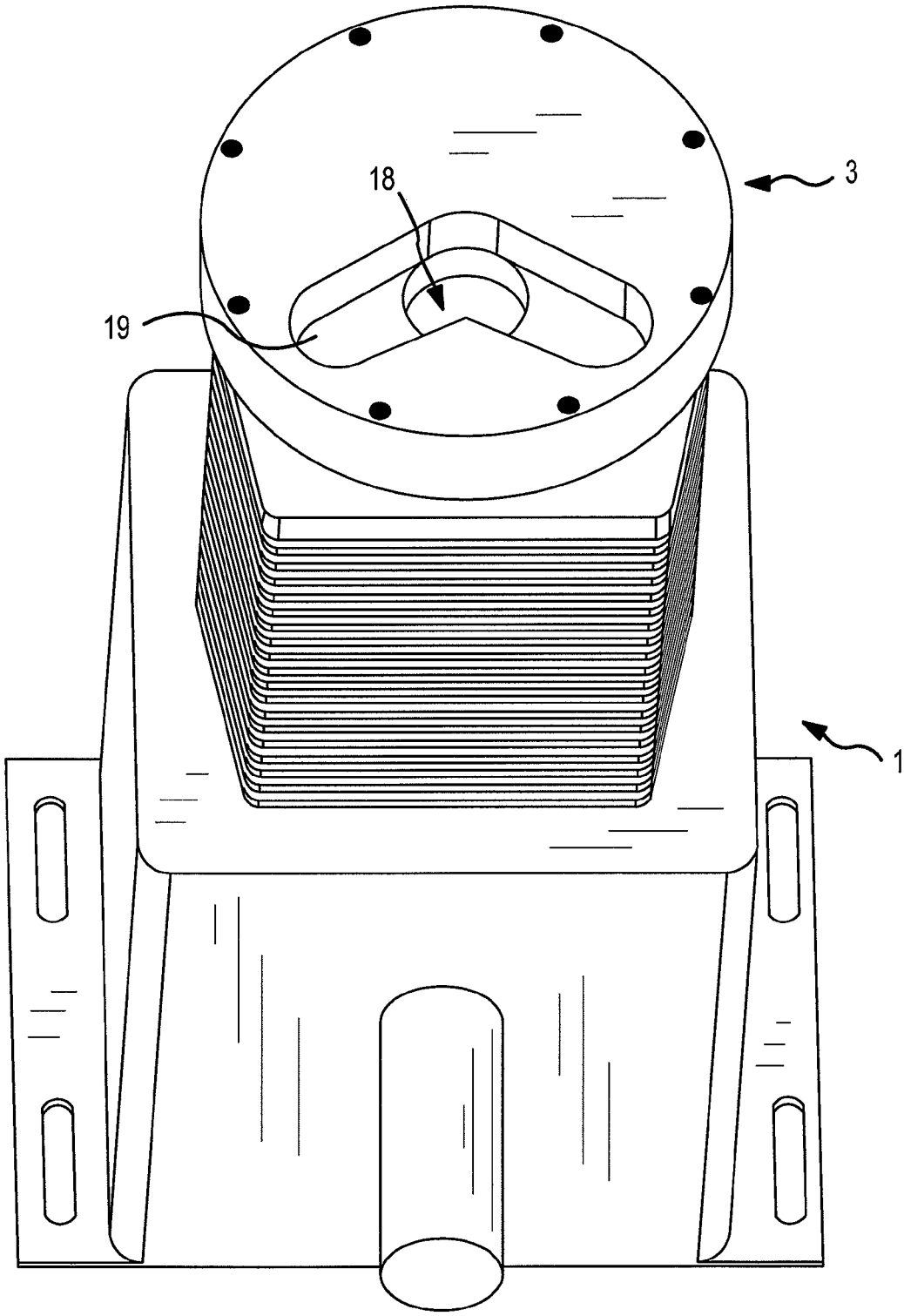
FIG. 4 is a perspective view of the compressor as is shown in FIG. 1 with only the first plate installed on the compressor cylinder.

FIG. 4 is a perspective view of the compressor (1) with the first plate connected to the top of the compressor cylinder. In the illustrated embodiment, the first plate (3) has a larger diameter than the compressor (1). In the illustrated embodiment, the opening (18) is preferably axially aligned with the axis of the piston (not visible) and/or the compressor (1). As such, fluids entering and exiting the compressor (1) are aligned with the axis of the piston's motion, thus minimizing the torque on the piston. If the opening or port (18) is not aligned with the piston, torque on the piston may cause the piston to rub against the inside of the compressor (1) and thus increase friction and decrease the compressor lifetime as well as decrease compressor efficiency. Furthermore, fluids exiting the compressor pass through the opening (18) and can travel in two directions through the channel (19). Fluids entering the compressor (1) via the opening (18) can do so via either side of the V-shaped channel (19).

Figure 5:
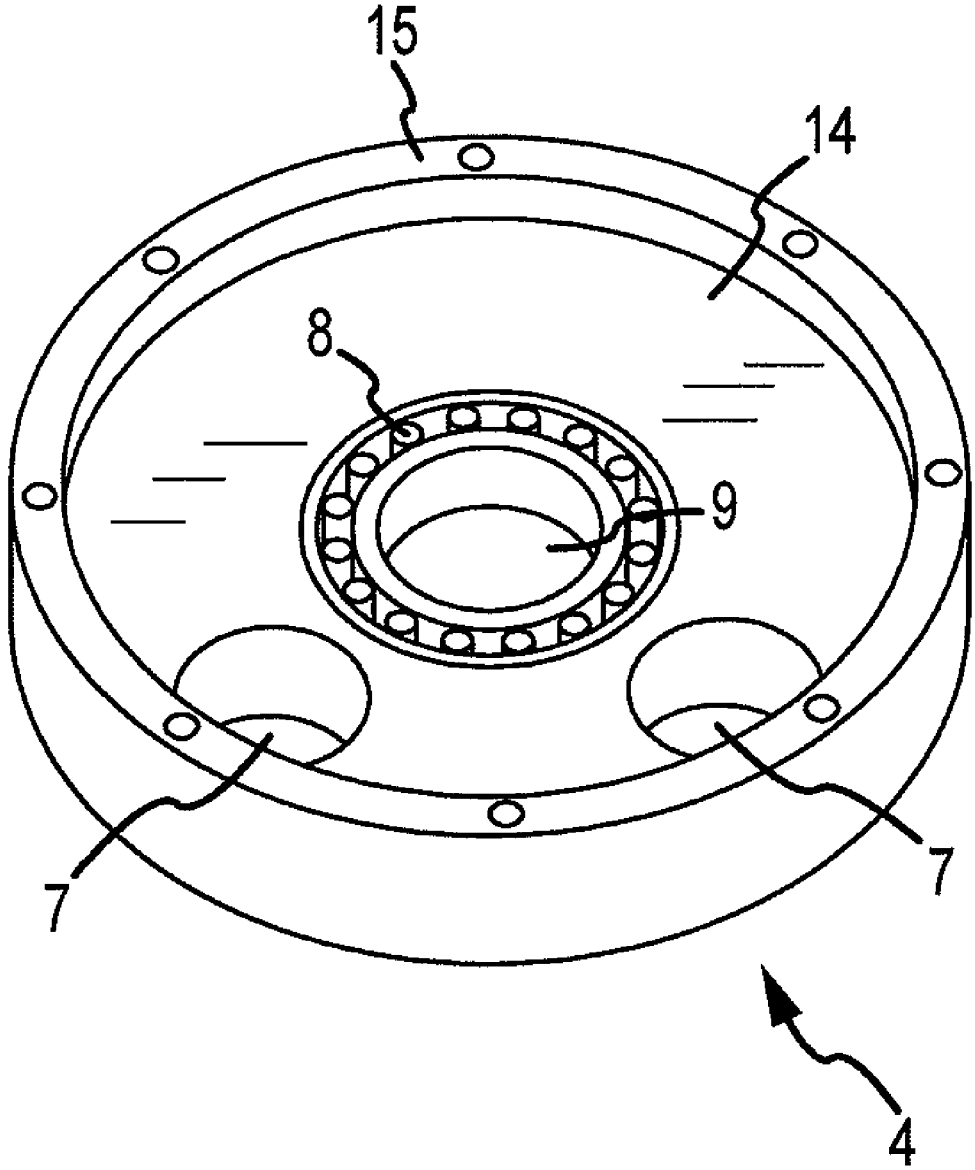
FIG. 5 is an upper perspective view of a second plate of a cylinder cover head shown separate from the compressor shown in FIG. 1.

FIG. 5 is an upper separate perspective view of one embodiment of a second plate of a cylinder head cover. The second plate (4) is a flat plate with a central portion (14) and a raised annular rim portion (15) and a central blind recess (9) in the central portion (14) housing a roller bearing (8) therein (e.g., journal roller bearing). The purpose of the roller bearing (8) is to support the lower end of the third plate axle as explained further below. The second plate (4) has two spaced openings (7). These openings are space so as to align over the ends of the V-shaped channels (19) when the second plate 4 is installed on the first plate (3). Fluids can pass through one opening (7) and out the other opening (7). The second plate (4) may also comprises roller bearings (8) or some other low-friction system enabling the second plate (4) to support the third plate (see FIG. 8-10), and enabling the third plate (5) to rotate relative to the second plate (4).

Figure 6:
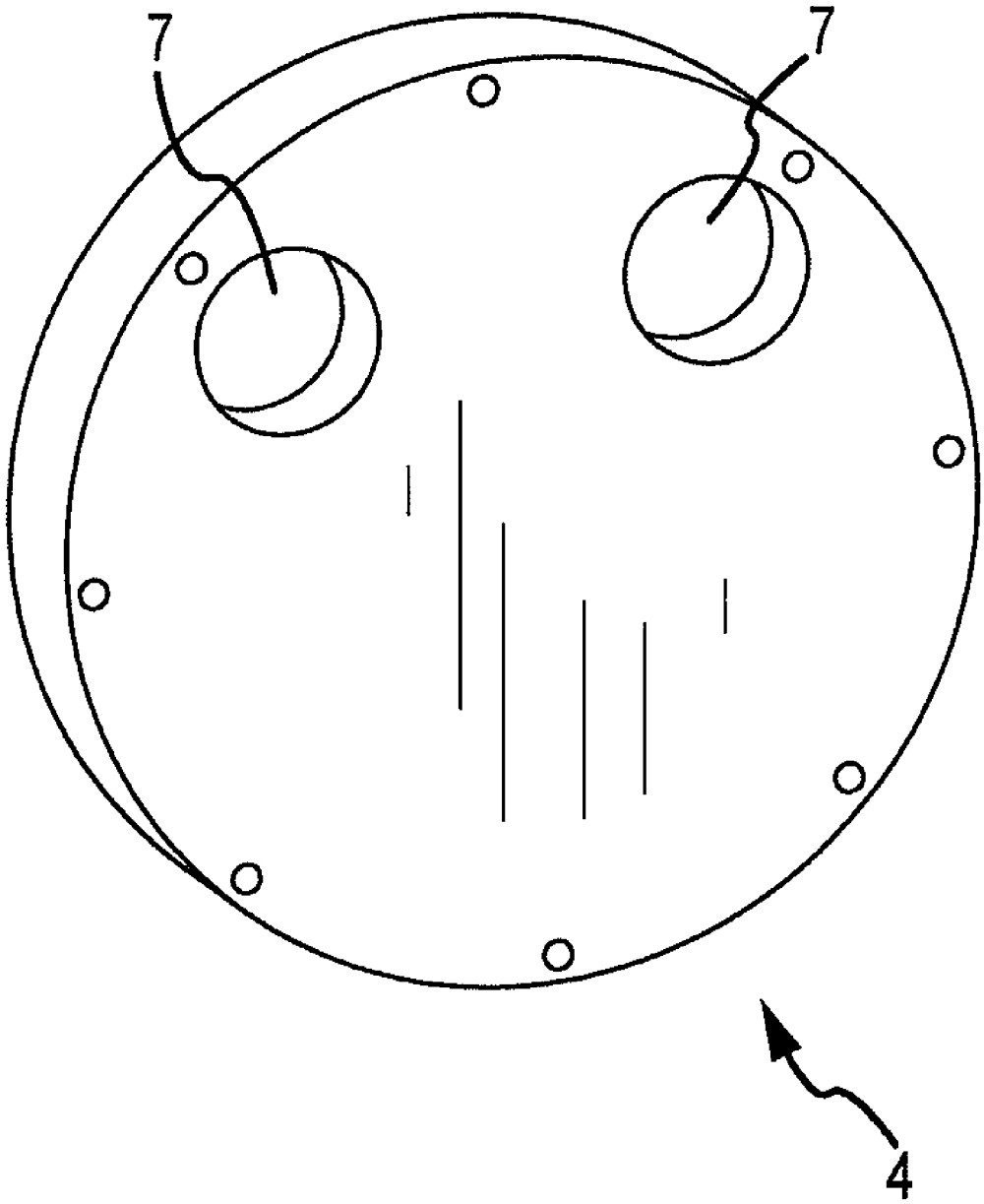
FIG. 6 is a bottom perspective view of the second plate of FIG. 5.

FIG. 6 illustrates a bottom view of the second plate of FIG. 5 showing that the bottom surface is flat.

Figure 7:
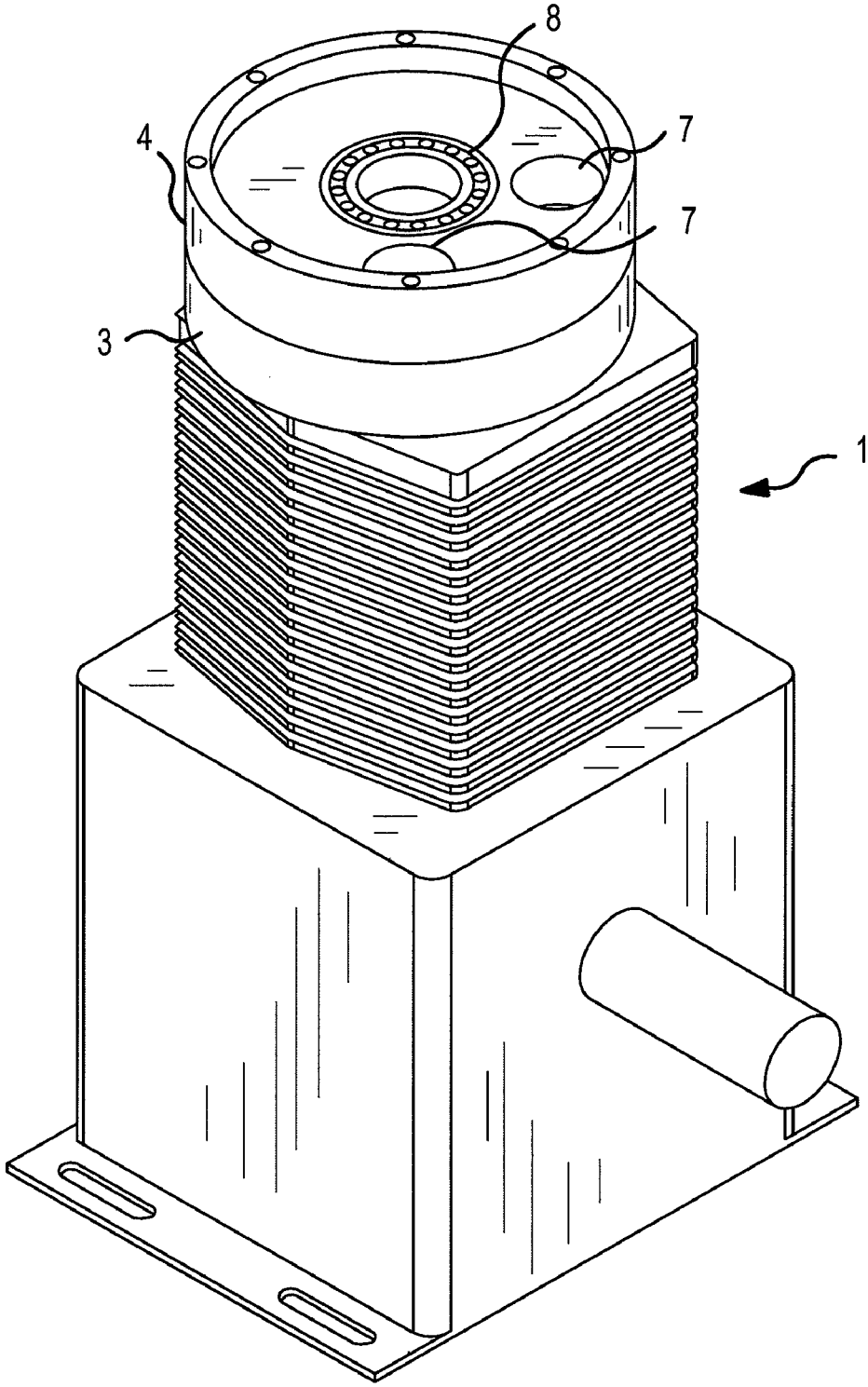
FIG. 7 is a perspective view of the compressor as is shown in FIG. 1 with the first and second plates of a cylinder cover head installed on the cylinder.

FIG. 7 is a perspective view as in FIG. 1 with the first and second plates (3) and (4) installed on the compressor cylinder (1).

Figure 8:
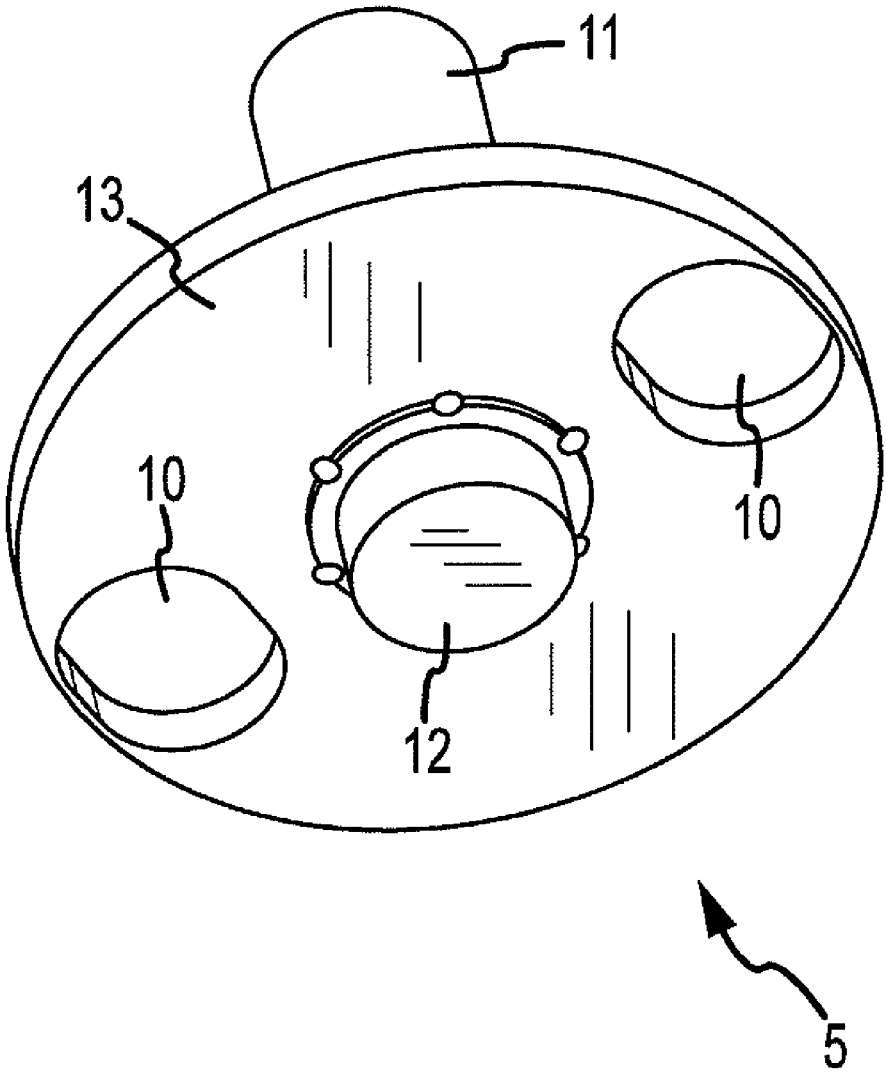
FIG. 8 is a bottom perspective view of one embodiment of the third, or valve, plate of the cylinder head cover separate from the compressor shown in FIG. 1.

FIG. 8 is a separate bottom perspective view of the third, or rotary valve, or rotary plate (5) of a cylinder head cover (2) in accordance with the disclosure. In the illustrated embodiment, the third plate (5) includes an axle shaft (11) having a bottom portion (12) extending through the center of the plate (5). The axle (11) is fixed to the bottom surface (13) of plate (5). The bottom portion (12) of the axle (11) can rest in the roller bearings (8) with the plate (5) spaced inside the rim portion (15) and sandwiched between the second plate (4) and the fourth plate (6) as explained below. In the illustrated embodiment, the third plate (5) has two spaced oblong openings (10) preferably spaced diametrically apart).

Figure 9:
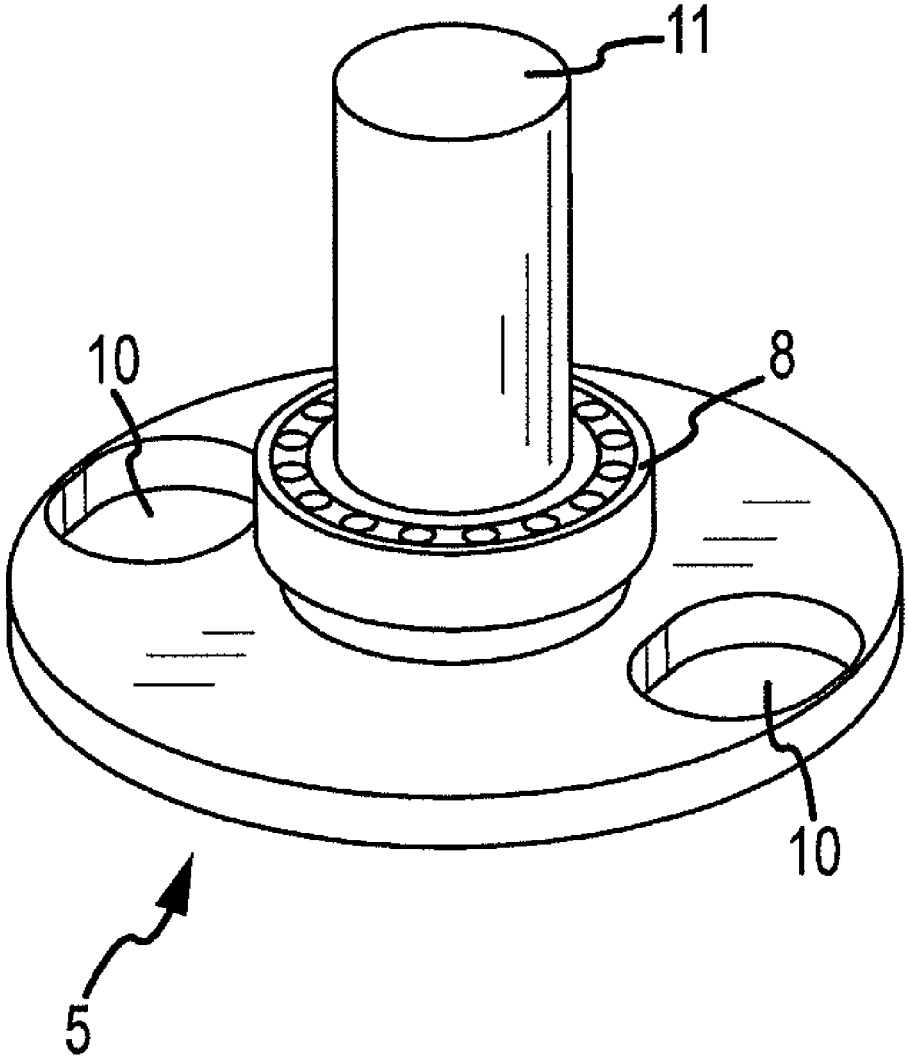
FIG. 9 is an upper perspective view of the valve, or third, plate of the cylinder head cover shown in FIG. 8.

FIG. 9 is an upper perspective, view of the third, (or rotary) plate (5) on the axle shaft (11) as in FIG. 8. The third plate (5) also includes an upper roller bearing (8) similar to the lower roller bearing (8) recessed into central portion (14) of the second plate (4) as can be seen in FIG. 7.

Figure 10:
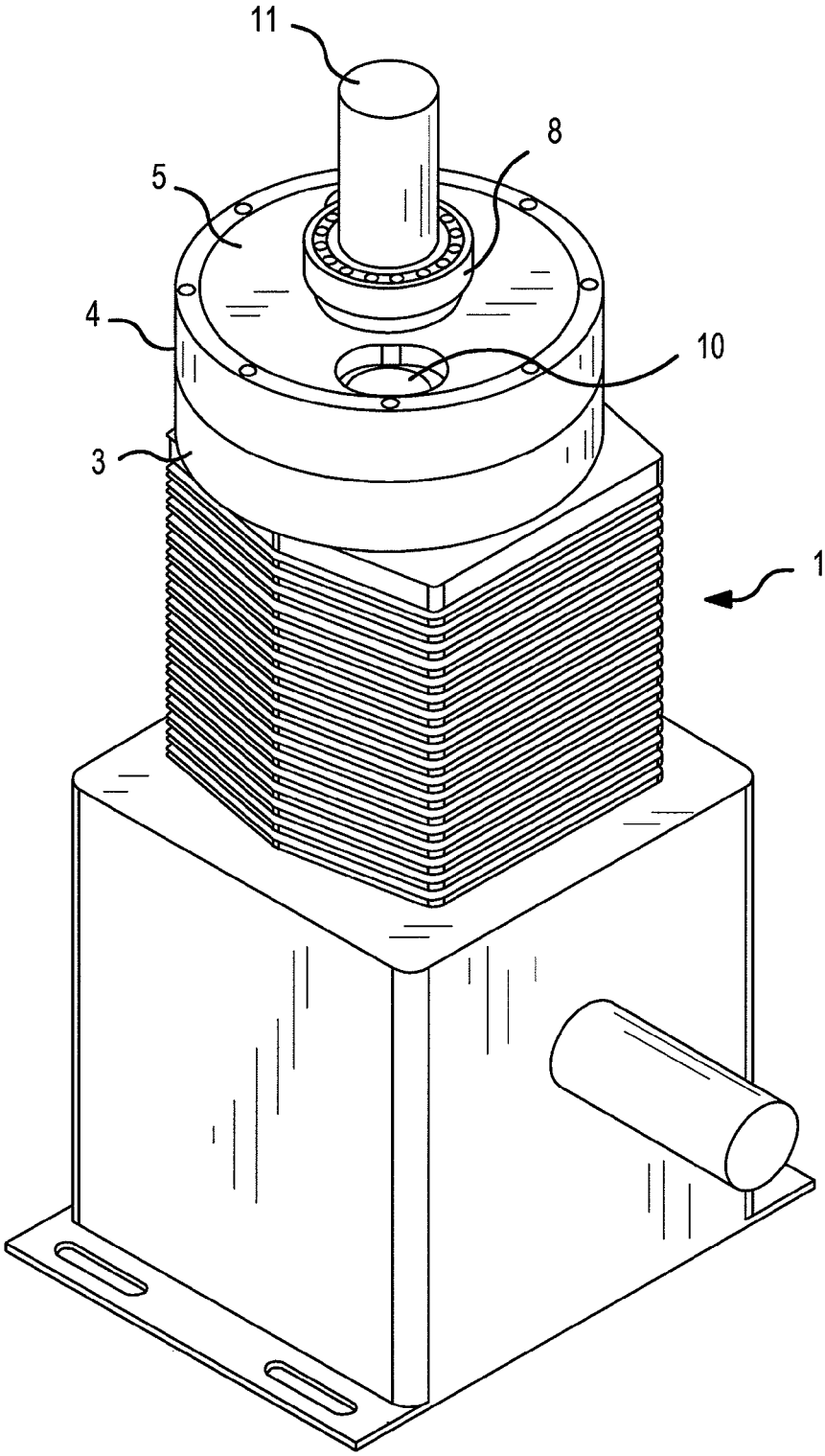
FIG. 10 is an upper perspective view of the compressor cylinder shown in FIG. 1 with the first, second, and third plates installed on the top of the compressor cylinder.

FIG. 10 illustrates the first, second, and third plates of a cylinder head cover (2) in accordance with the present disclosure installed on the compressor cylinder (1). In this view, the third plate (5) is rotatably connected to the second plate (4) via the roller bearing (8). The diameter of the third plate (5) is less than the inner diameter of the rim portion (15) of the second plate (4). As such, the third plate (5) fits within the rim portion (15) of the second plate (4). In the illustrated embodiment, the oblong openings (10) are at such a radius from the center of the third plate that they may align with the openings (7) of the second plate (4).

In an embodiment, the third plate (5) spins or rotates with the axle (11) in a synchronized fashion with the piston. In the middle of the piston's cycle, one opening (10) of the third plate (5) may be aligned with one opening (7) of the second plate (4). As such, fluids can enter or exit the compressor (1). The other opening (10) of the third plate (5) is not aligned with the other opening (7) of the second plate (4), and thus fluids can not pass through the other opening (7). Thus, at any time when one set of openings (7), (10) is open to fluid entry/exit, the other set of openings (7), (10) is not open. As the third plate (5) spins, each of the openings (10) will pass over and align with each of the openings (7) of the second plate (4) preferably once during a rotation.

Figure 11:
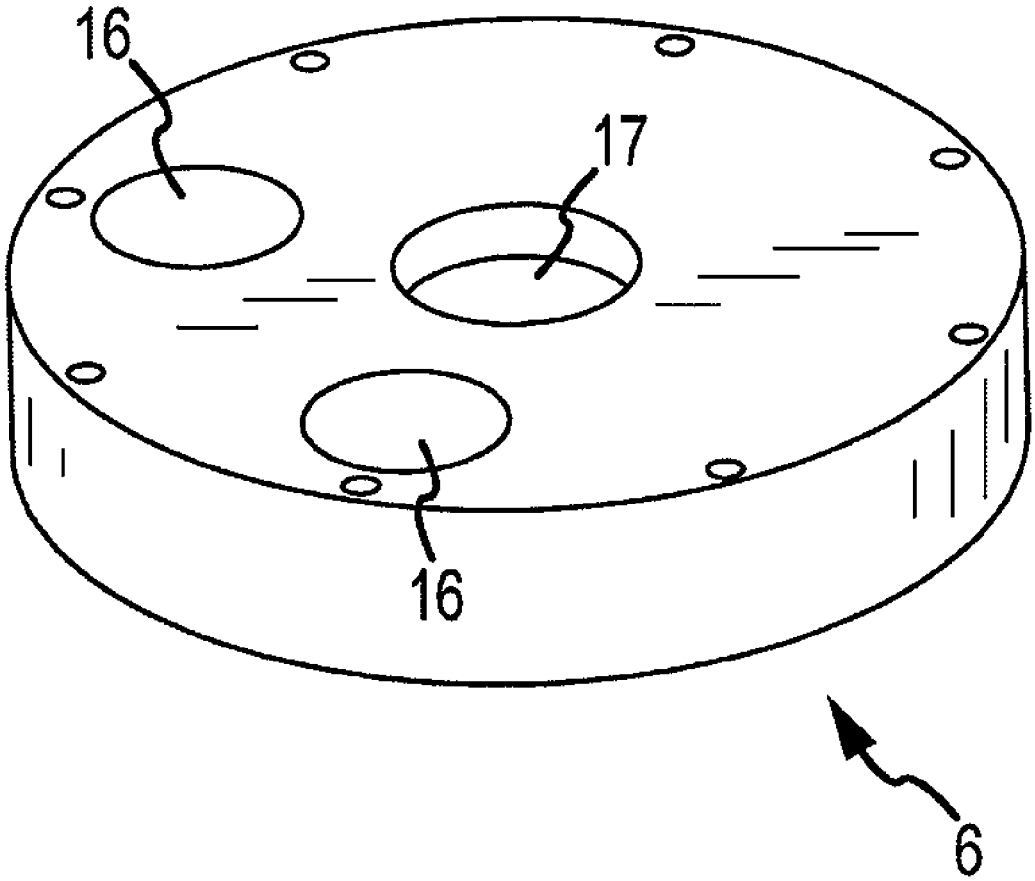
FIG. 11 is an upper perspective view of the fourth plate of the cylinder head cover separated from the compressor cylinder shown in FIG. 1.
Figure 12:
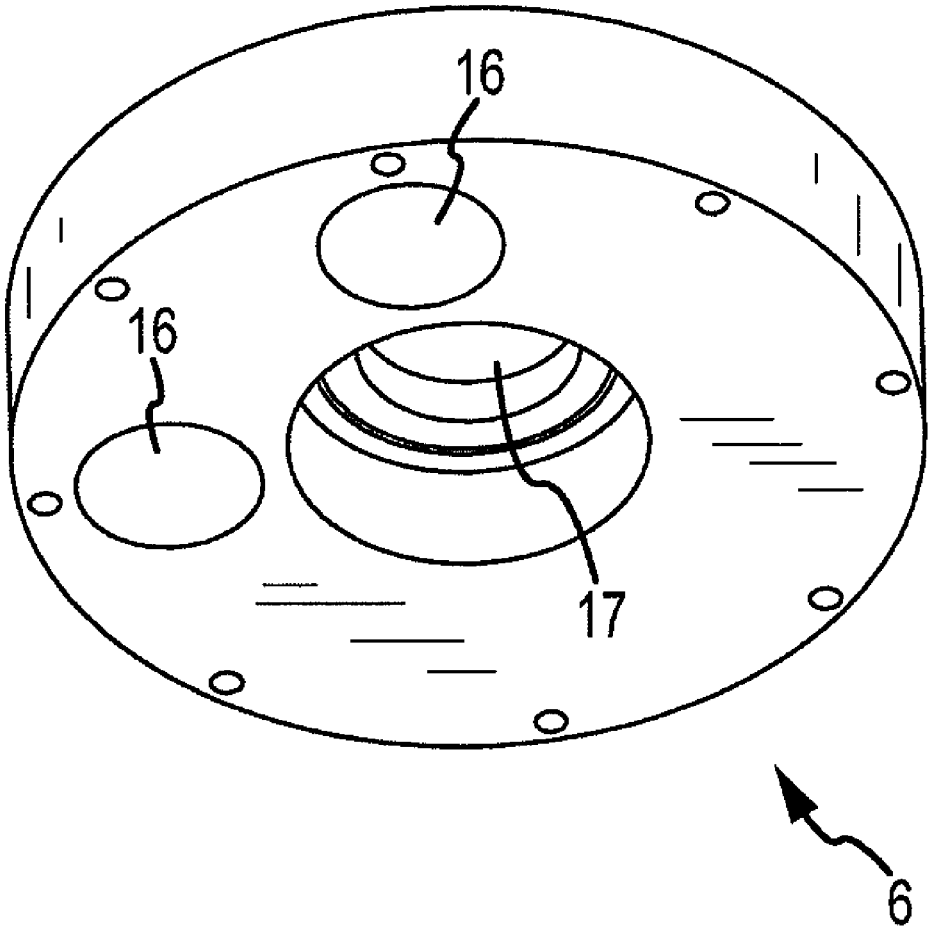
FIG. 12 is a bottom perspective view of the fourth plate shown in FIG. 11.

FIG. 11 is an upper perspective separate view of one embodiment of a fourth plate of a cylinder head cover (2) in accordance with the present disclosure. The fourth plate (6) again is a flat, disc shaped plate with a central axial bore 17 therethrough and a pair of spaced entrance/exit openings or ports (16) therethrough. FIG. 12 is a bottom perspective view of the fourth plate of FIG. 11. Again, the bottom surface, like the upper surface, of the fourth plate (6) is flat. The central axial bore (17) has a circular recess sized to receive and support the upper roller bearing (8) on the axle (11) when the fourth plate (6) is installed on the second plate (4).

Figure 13:
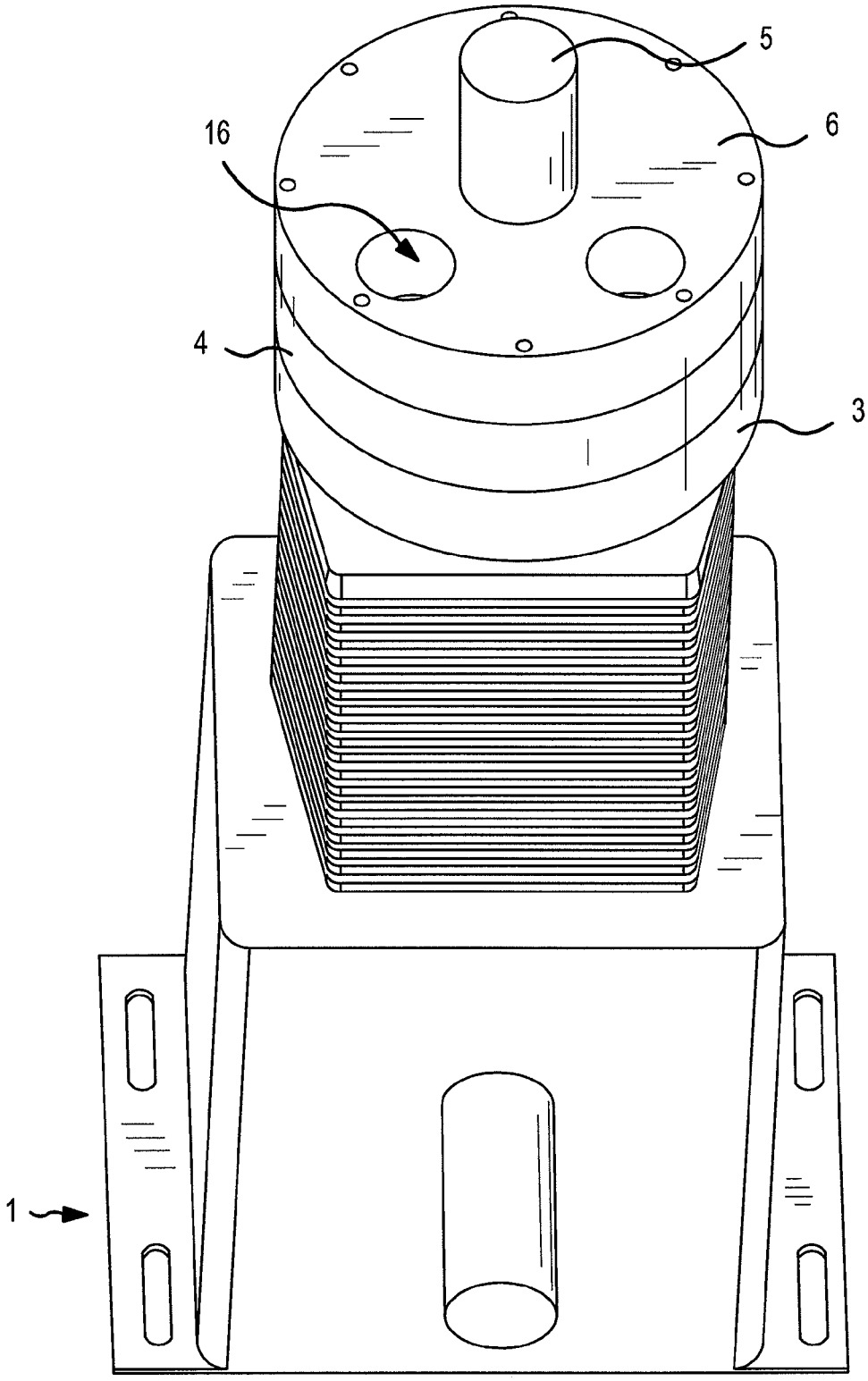
FIG. 13 is a perspective view of the compressor cylinder shown in FIG. 1 with the first, second, third, and fourth plates of the cylinder head cover of the present disclosure installed on the cylinder.

FIG. 13 is an assembled perspective view of the compressor (1) with the first, second, third, and fourth plates of a cylinder head cover installed, wherein the first plate is connected to the top of the compressor. In the illustrated embodiment, the third plate (5) is not visible as it resides within a chamber formed between the second plate (4) and the fourth plate (6). Only the axle (11), attached to the third plate (5), is seen protruding from the fourth plate (6), The axle (11) may have a pulley installed on it, or gear teeth thereon, as is illustrated, for example, in FIG. 1. A force applied to the teeth will turn the axle (11), which in turn rotates the third plate (5). Each turn or cycle of the compressor will correlate with a half turn of the third plate (5).

One advantage of the cylinder head cover in accordance with the present disclosure is to obtain fluid flow rates, fluid pressure, and device rotation that are not possible with existing cylinder head covers. The cylinder head cover in accordance with the disclosure set forth above may be utilized in a variety of reciprocating piston/cylinder arrangements, such as in internal combustion engines, air and gas compressors, and other fluid compressor applications. Other embodiments, enabling these advantages should also be apparent to one skilled in the art.

While various embodiments of the present disclosure have been described in detail, it is apparent that modifications and adaptations of those embodiments will occur to those skilled in the art. However, it is to be expressly understood that such modifications and adaptations are within the spirit and scope of the present disclosure.

What is claimed is:

1. A cylinder head comprising:

a first plate having first and second opposite surfaces, a first and second channel in a first surface of the first plate, wherein the first and second channels extend in the first surface and do not extend in the second surface, and the channels merge together within the plate at a first opening extending at last into the second surface of the first plate;

a second plate over the first plate, the second plate having a pair of bores therethrough each aligned with one of the first and second channels in the first plate;

a fourth plate over the second plate forming a cavity between the second and fourth plates;

a third plate rotatably disposed between the second and fourth plates, the third plate having a pair of spaced bores therethrough for sequentially aligning with one of the pair of bores through the second plate; wherein the fourth plate has a pair of spaced bores therethrough aligned with the bores through the second plate, wherein during a full rotation of the third plate each bore through the third plate aligns with each bore through the second and fourth plates, and an axle supporting the third plate, the axle having an upper bearing and a lower bearing, the upper bearing being supported in a recess in the fourth plate and the lower bearing being supported in a recess in the second plate.

2. The cylinder head according to claim 1 wherein at least one of the spaced bores through the third plate is oblong.

3. The cylinder head according to claim 1 wherein the second plate has a raised rim portion and a flat central portion, the central portion having a central blind recess therein for receiving a lower bearing for supporting the third plate.

4. The cylinder head according to claim 3 wherein the fourth plate has a central recess receiving an upper bearing for rotatably supporting the third plate.

5. The cylinder head according to claim 1 wherein the bores through the second and fourth plates are spaced apart by an angle greater than 90 degrees.

6. The cylinder head according to claim 1 wherein the opening through the second surface of the first plate is axially positioned over a piston in a cylinder when the first plate is fastened onto the cylinder.

7. The cylinder head according to claim 6 wherein the axle is axially aligned with the piston when the cylinder head cover is installed.

8. The cylinder head according to claim 1 wherein the system is operational with no less than four separate plates.

9. The cylinder head according to claim 1 wherein the first plate is positioned over a piston in a cylinder, and wherein the first plate, second plate, third plate, and fourth plate are of a diameter different to the piston head, and the first second, third and fourth plates are axially mounted offset relative to the axis of the piston head.

10. The cylinder head according to claim 1 wherein the second plate includes an upstanding circumferential rim about the outer periphery of the plate, and a recess between the rim and the area within the periphery.

11. The cylinder head according to claim 10 wherein the second plate includes a ring of bearings about a central axis, the ring being supporting the third plate and for facilitating rotation of the third plate relative to the second plate, and the third plate having a depth such that it fits wholly within the recess and below the top of the rim.

12. The cylinder head according to claim 10 including two spaced openings between the bearing and the rim, the openings being substantially circular in cross section and extending from one surface of the plate to the other surface.

13. The cylinder head according to claim 1 wherein the second plate includes a ring of bearings about a central axis, the ring being supporting the third plate and for facilitating rotation of the third plate relative to the second plate.

14. The cylinder head according to claim 1 wherein the third plate includes an upstanding shaft for extending through an aperture in the fourth plate, and included a ring of bearings for supporting the fourth plate, and whereby the rotation of the third plate is facilitated relative to the fourth plate.

15. The cylinder head according to claim 1 wherein the third plate includes at least two apertures extending between the opposite surfaces of the fourth plate, the apertures being oblong, such that the longer axis of the oblong apertures extend circumferentially relative to a shorter axis which extends radially.

16. A cylinder head for use on a cylinder containing a piston reciprocating along an axis through the cylinder, the cover comprising:

stationary first, second and fourth axially aligned plates and a rotary third plate enclosed between the second and fourth plates;

a first plate having first and second opposite surfaces, a first and second channel in a first surface of the first plate, wherein the first and second channels extend in the first surface and do not extend in the second surface, and the channels merge together within the plate at a first opening extending at last into the second surface of the first plate, the first plate having a single bore therethrough, wherein the bore is non-axially aligned with the piston axis, the bore leading from a second surface of the first plate and diverging into a V-shaped channel through the first surface thereof;

the second stationary plate being positioned axially on the first plate, the second plate having a flat bottom surface, a peripheral rim portion fastened to the first plate, and a central axially recessed portion, the central axially recessed portion having a pair of spaced holes therethrough each aligned with and communicating with a different end of the V-shaped channel in the top surface of the first plate, the central recessed portion having a central axial blind bore housing an annular lower radial bearing therein;

the stationary fourth plate fastened to the rim portion of the second plate forming a cavity between the fourth plate and the central portion of the second plate, the fourth plate having a central axial bore therethrough and two axial bores therethrough each spaced from the central bore and arcuately spaced from each other, the central bore including a bearing recess for receiving and supporting an upper radial bearing therein; and an axial shaft having the upper and lower bearings thereon sandwiching the rotary third plate therebetween, the rotary third plate being positioned in the cavity between the second and fourth plates, the rotary third plate having a pair of ports therethrough such that as the shaft rotates the third plate, the ports sequentially align with the bores through the second and fourth stationary plates.

17. The cylinder head according to claim 16 wherein the system is operational with no less than four separate plates.

18. The cylinder head according to claim 16 wherein the first plate is positioned over a piston in a cylinder, and wherein the first plate, second plate, third plate, and fourth plate are of a diameter different to the piston head, and the first second, third and fourth plates are axially mounted offset relative to the axis of the piston head.

19. The cylinder head according to claim 16 wherein the second plate includes an upstanding circumferential rim about the outer periphery of the plate, and a recess between the rim and the area within the periphery.

20. The cylinder head according to claim 19 wherein the second plate includes a ring of bearings about a central axis, the ring being supporting the third plate and for facilitating rotation of the third plate relative to the second plate, and the third plate having a depth such that it fits wholly within the recess and below the top of the rim.

21. The cylinder head according to claim 19 including two spaced openings between the bearing and the rim, the openings being substantially circular in cross section and extending from one surface of the plate to the other surface.

22. The cylinder head according to claim 16 wherein the second plate includes a ring of bearings about a central axis, the ring being supporting the third plate and for facilitating rotation of the third plate relative to the second plate.

23. The cylinder head according to claim 16 wherein the third plate includes an upstanding shaft for extending through an aperture in the fourth plate, and included a ring of bearings for supporting the fourth plate, and whereby the rotation of the third plate is facilitated relative to the fourth plate.

24. The cylinder head according to claim 16 wherein the third plate includes at least two apertures extending between the opposite surfaces of the fourth plate, the apertures being oblong, such that the longer axis of the oblong apertures extend circumferentially relative to a shorter axis which extends radially.

25. A fluid compressor comprising:

a cylinder having a central axis;

an axially reciprocating piston housed within the cylinder; and a cylinder head cover over the cylinder, the cylinder head cover comprising:

a first plate having first and second opposite surfaces, a first and second channel in a first surface of the first plate, wherein the first and second channels extend in the first surface and do not extend in the second surface, and the channels merge together within the plate at a first opening extending at last into the second surface of the first plate;

a second plate over the first plate, the second plate having a pair of bores therethrough each aligned with one of the first and second channels in the first plate;

a fourth plate over the second plate forming a cavity between the second and fourth plates;

a third plate rotatably disposed between the second and fourth plates, the third plate having a pair of spaced bores therethrough for sequentially aligning with one of the pair of bores through the second plate, wherein the fourth plate has a pair of spaced bores therethrough aligned with the bores through the second plate, wherein during a full rotation of the third plate each bore through the third plate aligns with each bore through the second and fourth plates; and an axle supporting the third plate, the axle having an upper bearing and a lower bearing, the upper bearing being supported in a recess in the fourth plate and the lower bearing being supported in a recess in the second plate.

26. The compressor according to claim 25 wherein at least one of the spaced bores through the third plate is oblong.

27. The compressor according to claim 25 wherein the second plate has a raised rim portion and a flat central portion, the central portion having a central blind recess therein for receiving a lower bearing for supporting the third plate.

28. The compressor according to claim 27 wherein the fourth plate has a central recess receiving an upper bearing for rotatably supporting the third plate.

29. The compressor according to claim 25 wherein the bores through the second and fourth plates are spaced apart by an angle greater than 90 degrees.

30. The compressor according to claim 25 wherein the first opening through the bottom surface of the first plate is axially positioned over a piston in a cylinder when the first plate is fastened onto the cylinder.

31. The compressor according to claim 30 wherein the axle is axially aligned with the piston when the cylinder head cover is installed.

* * * * *